US005405140A

United States Patent [19]

Terlinden et al.

[11] Patent Number: 5,405,140

[45] Date of Patent: Apr. 11, 1995

[54] FAMILY VACATION BOARD GAME

[76] Inventors: Joyce A. Terlinden, 856 Golf-Vu Dr., Fond du Lac, Wis. 54935; Roger A. Christopherson, 4400 Placita Rebecca, Tucson, Ariz. 85741

[21] Appl. No.: 313,913

[22] Filed: Sep. 28, 1994

[51] Int. Cl.[6] ..... A63F 3/04

[52] U.S. Cl. ..... 273/251; 273/252; 273/146

[58] Field of Search ..... 273/243, 248, 249, 251, 273/252, 254, 257, 279, 146

[56] References Cited

U.S. PATENT DOCUMENTS

| | | | |
|---|---|---|---|
| 607,013 | 7/1898 | Boig | 273/248 |
| 1,065,775 | 6/1913 | Brewer . | |
| 1,538,134 | 5/1925 | Muir . | |
| 2,128,608 | 8/1938 | Goertemiller . | |
| 2,268,433 | 12/1941 | Smith . | |
| 3,414,264 | 12/1968 | Schriber | 273/248 |
| 3,433,483 | 3/1969 | Ellis | 273/248 |
| 3,649,022 | 3/1972 | Clark, Jr. | 273/248 X |
| 4,049,276 | 9/1977 | Hole | 273/252 |
| 4,078,803 | 3/1978 | Te . | |
| 4,082,284 | 4/1978 | Jennings . | |
| 4,368,889 | 1/1983 | Reker, Jr. . | |
| 4,784,394 | 11/1988 | Sumin . | |
| 4,887,818 | 12/1989 | Escott . | |
| 4,930,788 | 6/1990 | Roccanova | 273/248 |
| 4,932,666 | 6/1990 | Corle . | |
| 4,966,372 | 10/1990 | Robison | 273/252 |
| 5,102,339 | 4/1992 | Parriera | 273/248 X |

FOREIGN PATENT DOCUMENTS

| | | | |
|---|---|---|---|
| 889725 | 2/1962 | United Kingdom | 273/246 |
| 922772 | 4/1963 | United Kingdom . | |
| 1266949 | 3/1972 | United Kingdom . | |
| 2205762 | 12/1988 | United Kingdom . | |

*Primary Examiner*—William E. Stoll
*Attorney, Agent, or Firm*—Richard C. Litman

[57] ABSTRACT

A family vacation board game provides a geopolitical map of the United States as a game board, with plural playing paths thereacross. The object of the game is to be the first player to complete a round trip across the board, using a randomly selected playing path each way. Special dice are used for the playing path selection at the beginning of the game and at the beginning of the return trip, and for the determination of the magnitude of each move and drawing of dividend and hazard cards during the course of play. Simulated currency is provided at the beginning of the game, with simulated financial transactions occurring according to the cards drawn. In addition, positions are provided adjacent to the playing paths, which provide an opportunity for players to accrue additional money by correctly answering questions relating to U.S. geography when the players achieve those positions. Two conditions are required before a player may win the game: First, the player must have a positive fiscal balance, and secondly, the player must achieve the exact number of spaces or positions required to hit the finishing position precisely. These requirements enable other players to gain on the leader while he/she attempts to achieve the above two conditions, resulting in closer competition at the end of the game.

16 Claims, 3 Drawing Sheets

56

FAMILY VACATION BOARD GAME

FIELD OF THE INVENTION

The present invention relates generally to board games, and more specifically to a board game simulating a family vacation or trip by automobile or the like and using a geopolitical map of the United States as a game board. The game simulates travel over various routes across the board, with various rewards and pitfalls during the course of play.

BACKGROUND OF THE INVENTION

The knowledge a person must learn in order to cope in the modern world, continues to increase as time passes. As such, it often occurs that knowledge which was considered a basic requirement in the past, has received less emphasis in deference to other matters. Numerous studies have consistently shown that most young persons in the United States have at best only a superficial knowledge of the most basic facts of the geography of their country, particularly in comparison to their peers in other countries. On the other hand, students and others who are presented with such knowledge in an entertaining and enjoyable environment, will find it much easier to absorb and retain such knowledge.

Accordingly, the need arises for a game which may be used in the school environment or with smaller groups, such as families, which game simulates a vacation or other trip across the United States by car. The game should avoid undue complexity, enabling smaller children to enjoy the game and to have a fair chance at winning, and should present geographical knowledge to the players.

DESCRIPTION OF THE PRIOR ART

U.S. Pat. No. 1,065,775 issued to Charles B. Brewer on June 24, 1913 discloses a Game simulating the early U.S. Parcel Post system, using dice to determine the simulated weight of a parcel and the distance over which it is moved. No particular knowledge of geography is required nor taught by the game, as it relies purely upon chance means for advancement. The game may be played on any configuration board, and is not limited to a map of the U.S.

U.S. Patent No. 1,538,134 issued to Charles S. Muir on May 19, 1925 discloses a Game simulating travel through the solar system and stars. Pure chance is used in determining the advancement of the playing pieces during the course of the game, and only celestial objects with a single playing path therebetween are represented. No financial transactions are disclosed.

U.S. Pat. No. 2,128,608 issued to Clarence C. Goertemiller on Aug. 30, 1938 discloses a Game having a convoluted path representing a route across the U.S., but no geopolitical map is disclosed and the path does not truly resemble an actual route. Cards may be drawn during play which reward or penalize the player drawing the card(s), but only a single playing path is provided and no knowledge of geography is required or provided in the game.

U.S. Pat. No. 2,268,433 issued to Mabel M. Smith on Dec. 30, 1941 discloses an Amusement Game using a geopolitical map of the United States as a playing board. The game simulates the buying, selling and railroad transport of various commodities during play, and depends primarily upon chance means for advancement. In only one relatively simple embodiment is any geographical knowledge called for, and no financial transactions are involved.

U.S. Pat. No. 4,078,803 issued to Henry Te on Mar. 14, 1978 discloses a Board Game With Animal Tokens comprising a map of the world with multiple routes thereon. Each player receives a plurality of cards representing animals, with the object being to return these cards (animals) to the area of the board representing their native habitat. The outcome of the game is determined primarily by chance. No financial transactions are used.

U.S. Pat. No. 4,082,284 issued to John N. Jennings on Apr. 4, 1978 discloses a Board Game Apparatus including a general outline of the U.S. with multiple playing paths thereon. The game involves simulated travel across the U.S. using the game board, but also involves the capture and escape of opponents' playing pieces, unlike the present game. Again, no financial transactions are disclosed.

U.S. Pat. No. 4,368,889 issued to Louis M. Reker, Jr. on Jan. 18, 1983 discloses a Game Apparatus For Simulating School Experience in which multiple playing paths are provided, with the paths simulating a student's progress through school. As such, no geopolitical representation is provided, nor is any geographical knowledge required to excel in the play of the game. No financial transactions are disclosed by Reker, Jr. The present game, on the other hand, simulates physical travel across the U.S. and rewards geographical knowledge as the game is played.

U.S. Pat. No. 4,784,394 issued to Vitaly Sumin on Nov. 15, 1988 discloses a Tourist Game Apparatus directed to a specific relatively localized area. The players move tokens about a map of the area using actual transportation schedules (i.e., bus, subway, etc.) as they attempt to "visit" designated tourist areas. No particular geographic knowledge is required.

U.S. Pat. No. 4,887,818 issued to Suzanne Escott on Dec. 19, 1989 discloses an Airline Ownership And Travel Game in which the simulated purchase of airlines and their routes is accomplished. The object is to acquire as many airlines and routes as possible, thus requiring other players to pay for use of those airlines in their simulated travel, and thus bankrupt the other players. The present game does not involve ownership of travel routes.

U.S. Pat. No. 4,932,666 issued to Kenneth R. Corle on Jun. 12, 1990 discloses a Method Of Playing A Travel Board Game comprising a geopolitical map of the U.S. with a generally rectangular peripheral playing path thereabout. Movement of the game pieces is along the rectangular and convoluted peripheral playing path, rather than across plural playing paths on the U.S. map, as in the present game.

British Patent No. 922,772 to Frank Adams and published on Apr. 3, 1963 discloses a Means For Playing A Game comprising a circuitous playing path and cards providing for reward or penalty. The general subject of the game is traffic safety, and no geographic theme or knowledge is presented, nor are any financial transactions disclosed.

British Patent No. 1,266,949 to Dennis E. Flynn and published on Mar. 15, 1972 discloses an Apparatus For Playing A Game in which a roulette wheel is used to determine the magnitude of moves over the board, but also requiring correct responses to questions posed in French from a "key-book". No financial transactions are provided.

Finally, British Patent No. 2,205,762 to Christopher E. Murphy et al. and published on Dec. 21, 1988 discloses a Board Game simulating travel along a canal, by means of a single playing path. The exchange of commodities is simulated, but no financial transactions are disclosed.

None of the above noted patents, taken either singly or in combination, are seen to disclose the specific arrangement of concepts disclosed by the present invention.

SUMMARY OF THE INVENTION

By the present invention, an improved board game is disclosed.

Accordingly, one of the objects of the present invention is to provide an improved board game which provides an interesting and entertaining means of teaching players about the geography of the United States, by simulating a family vacation trip across the United States.

Another of the objects of the present invention is to provide an improved board game which provides a game board including a geopolitical map of the United States thereon, with multiple travel paths thereacross.

Yet another of the objects of the present invention is to provide an improved board game which game board includes plural travel paths thereacross, which players may travel along the same or different paths to complete a round trip across the board.

Still another of the objects of the present invention is to provide an improved board game which includes different chance means providing for the random selection of playing paths for each direction of travel across the board, and for the random selection of dividend or hazard cards during the course of play.

A further object of .the present invention is to provide an improved board game which provides additional rewards to players who correctly answer randomly drawn questions relating to U.S. geography during the course of the game.

An additional object of the present invention is to provide an improved board game which includes simulated currency and the exchange thereof during the course of play, depending upon the dividend or hazard situation encountered.

Another object of the present invention is to provide an improved board game which requires a player completing the round trip journey across the board, to have both a positive balance of simulated currency and to achieve an exact count to the finishing position using the chance move determination means.

Yet another object of the present invention is to provide an improved board game which chance determination means comprises two dice, one having three different colors on two faces each, and another with numerical representations from one to four and dividend and hazard card selection positions on the six faces.

A final object of the present invention is to provide an improved board game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
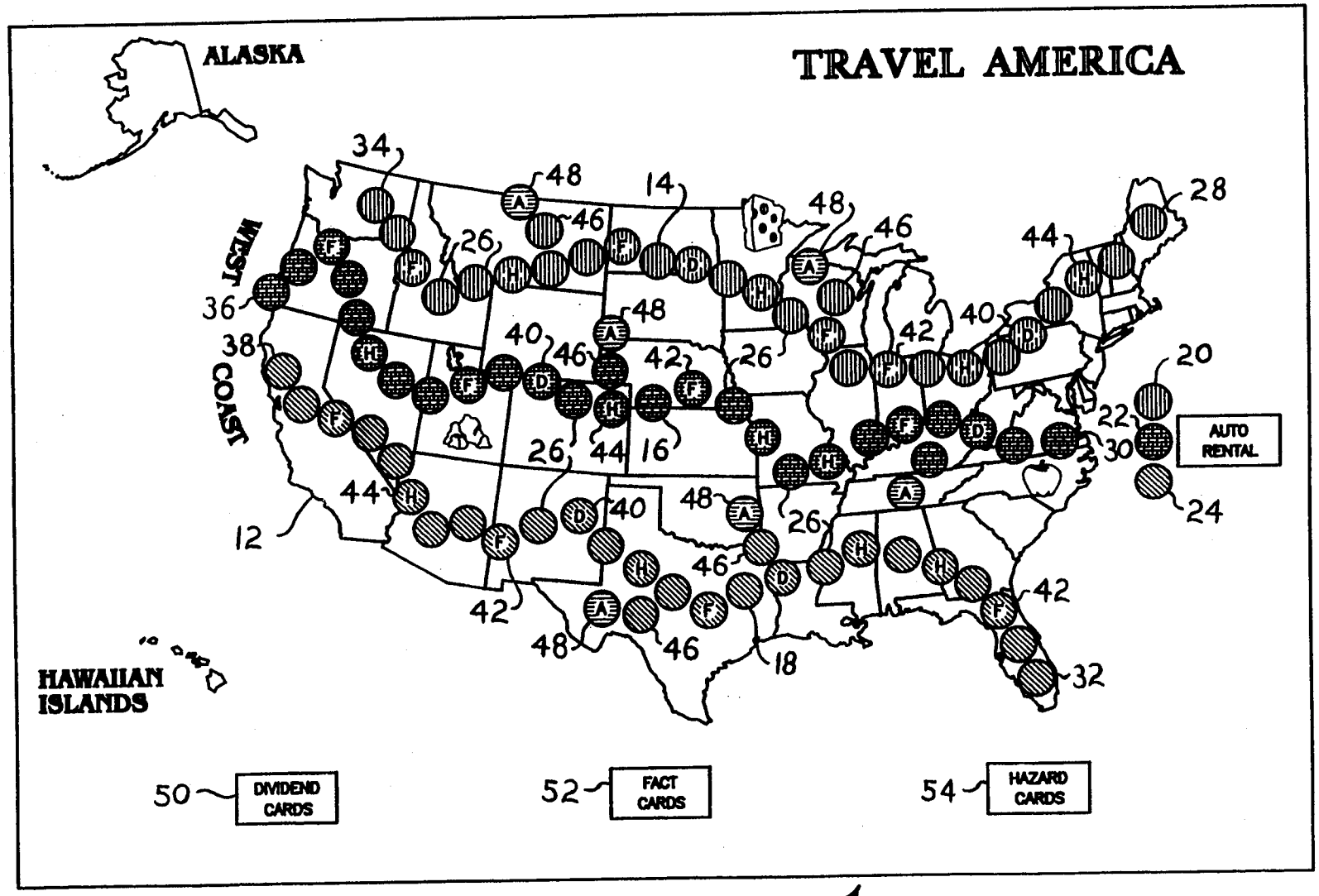
FIG. 1 is a plan view of the present game board, showing its various features.

Referring now to the drawings, the present invention will be seen to relate to a board game simulating family travel across the contiguous 48 states of the United States, as in vacation or other travel. The game includes a game board 10 including a geopolitical map 12 of the 48 contiguous United States thereon, with a plurality (preferably three, although the exact number may be varied) of playing paths or routes 14, 16 and 18 extending from east to west thereacross. The paths 14 through 18 are preferably color coded, with the first or northernmost path or route 14 being red, the second or central path 16 being yellow, and the third or southernmost path 18 being colored or shaded in green; other colors or means of differentiating the paths or routes may be used, e.g., differently shaped playing positions along the paths, etc.

The game provides common starting and ending points 20 through 24 respectively for each of the travel paths or routes 14 through 18, which may be located at some location adjacent to but outside the U.S. map 12 proper. The game board 10 provides for these starting and ending points 20 through 24 at a central location immediately off the east side of the U.S. map 12, designated as "auto rental," at which point the game begins and ends when each player "rents" their playing piece and "returns" their playing piece to the "rental" location at the end of the game. The common starting and ending points 20 through 24 may be color coded or otherwise marked to match their respective paths.

Each of the game travel paths 14 through 18 comprises the same number of positions 26, and extends generally across the map 12 from the east coast initial and finishing end position 28 through 32 to the west coast intermediate end position 34 through 38. Players must begin the game from their appropriate starting and ending point 20 through 24, travel across the map 12 along their designated travel path 14 through 18 to the respective intermediate end point or position 34, 36, or 38, whereupon the direction of travel is reversed and the players return along the same or a different travel path 14, 16, or 18 (as explained further below) and back to the initial/finishing end position 28 through 32 and thence to the appropriate respective common starting and ending position 20 through 24.

Each of the travel routes or playing paths 14 through 18 includes a plurality of positions which require the drawing of a dividend card, fact card, or hazard card (explained further below), which positions are designated respectively as dividend or D positions 40, fact or F positions 42, and hazard or H positions 44. In addition, each path 14 through 18 has a plurality of spurs 46 extending therefrom, with each of the spurs 46 including a "rest area" position 48 (designated with an A) at the end thereof. The same procedure applies when a player lands upon one of the rest area positions 48 as when he/she alights upon one of the fact positions 42 along one of the main routes 14 through 18, which procedure will be described further below. The dividend, fact and hazard card storage positions are indicated on the board 10 respectively at 50, 52, and 54, which positions provide for the placement and storage of the cards during play.

Figure 2:
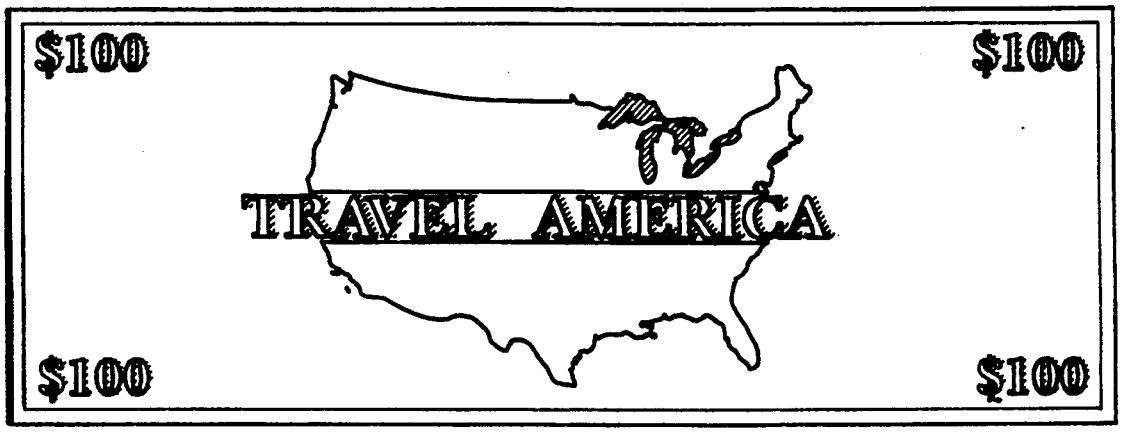
FIG. 2 is a view of one denomination of the simulated currency used in the play of the present game.

The present family travel game includes financial exchanges during the course of play, and accordingly simulated currency in various denominations is provided, e.g., $10, $20, $50, and $100; other denominations may be provided as desired. FIG. 2 discloses an exemplary bill 56 of $100 denomination.

Figure 3A:
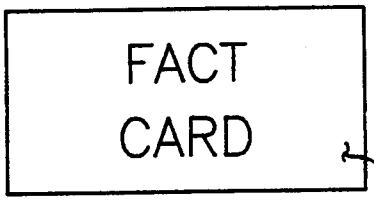
FIG. 3A is a view of the front face of a fact card used in the play of the present game.
Figure 3B:
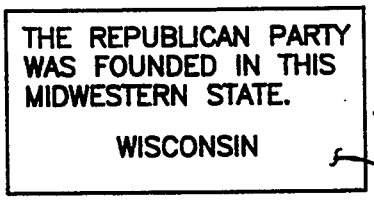
FIG. 3B is a view of the back face of the fact card of FIG. 3A, showing a typical question and corresponding answer.

FIGS. 3A and 3B disclose views respectively of the front face **58*a* and rear face 58*b* of a fact card 58 used in the play of the present game. Fact cards 58 are labeled as such on the front face 58*a*, and on the rear face 58*b*** each include a different question and answer relating to geographical, political, and other knowledge of the United States; the questions and their answers need not necessarily be limited to the contiguous United States on which the present game is played, but may include other U.S. areas. Examples are provided in the table following:

FACT CARDS

Figure 4A:
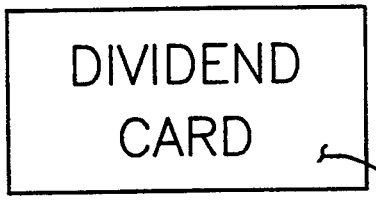
FIG. 4A is a view of the front face of a dividend card used in the play of the present game.
Figure 4B:
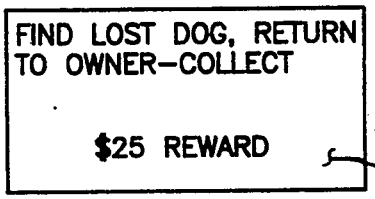
FIG. 4B is a view of the back face of the dividend card of FIG. 4A, showing a typical fortuitous occurrence and the amount of the reward provided.

Q. Mount McKinley, the highest point in the U.S., is located in this state.
A. ALASKA
Q. Name the state that is known for the great redwood forest.
A. CALIFORNIA
Q. This state is known as "The First State" because it was the first state to approve the Constitution.
A. DELAWARE
Q. Name the state that Stone Mountain is located in.
A. GEORGIA
Q. This state is known for its potatoes.
A. IDAHO The present game also includes a plurality of dividend cards 60, with an exemplary front and rear face **60*a* and 60*b* shown respectively in FIGS. 4A and 4B. Dividend cards 60 provide payment or positional advance to a player drawing such a card 60 during the course of the present game. Examples of such dividend cards 60** are provided below:

DIVIDEND CARDS

Stop at a rummage sale. Find Bargains.
Collect $20.00.
Win at the dog races.
Collect $20.00.
Report forest fire.
Collect $100.00.
Help traveler lost in the mountains.
Collect $50.00.
Find budget motel.
Collect $20.00.
Bypass city.
Move ahead three spaces.
Travel the expressway.
Move ahead five spaces.
Take ferry across lake.
Move ahead five spaces.
Deep sea fishing. Catch a record winning shark.
Collect $100.00.

Figure 5A:
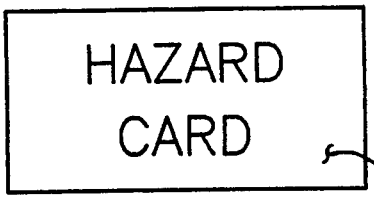
FIG. 5A is a view of the front face of a hazard card used in the play of the present game.
Figure 5B:
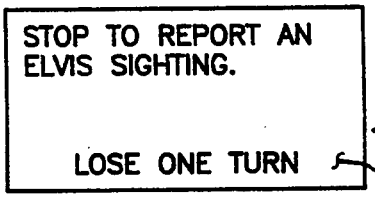
FIG. 5B is a view of the back face of the hazard card of FIG. 5A, showing a typical problem or setback and the penalty imposed thereby.

FIGS. 5A and 5B respectively disclose the front face **62*a* and rear face 62*b* of a typical hazard card 62. Hazard cards 62 provide some form of penalty for a player drawing such a card, in the form of positional setbacks or financial penalty; the result is the opposite of the dividend cards 60 discussed above. Examples of hazard cards 62** are shown below:

HAZARD CARDS

Stop for cattle crossing.
Miss one turn.
Get into poison ivy while walking in the woods. Lose travel time.
Lose one turn.
Big fish gets away with your fishing pole.
Pay $20 for a new one.
Stop to write postcards.
Pay $10 postage.
Stop at state line for "free" souvenirs.
Pay $10.
You miss your dog. Call the kennel.
Pay $10.
Tent knocked over by bears while camping in the woods.
Miss one turn.
While photographing sights, you back into a cactus.
Pay $10 for medical supplies.

Figure 6:
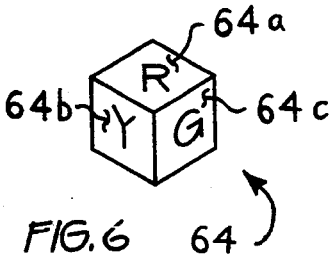
FIG. 6 is a perspective view of the color die used in the play of the present game, showing three of its six colored faces.

FIG. 6 discloses a perspective view of three sides **64*a*, 64*b*, and 64*c* of a six sided cubical route selection die 64 used in the play of the present game, with the other three sides being identical to the three sides 64*a* through 64*c* shown. The six sides include two red sides 64*a*, two yellow sides 64*b*, and two green sides 64*c*, respectively corresponding to the three playing paths or routes 14, 16, and 18. The die 64 is used by the players of the present game to determine which of the playing paths 14 through 18** will be used by each player at various points during the course of the game, as will be explained in the discussion of the play of the game further below.

Figure 7A:
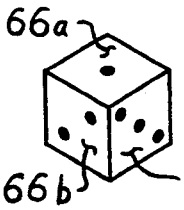
FIG. 7A is a perspective view of three of the six faces of the die used to control movement on the board, having the numbers one through three thereon.
Figure 7B:
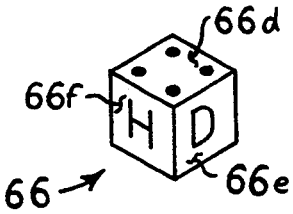
FIG. 7B is a perspective view of the other three faces of the die of FIG. 7A, with the number four and provision for drawing hazard and dividend cards thereon.

FIG. 7A discloses a perspective view of three sides 66*a*, 66*b*, and 66*c* of a six sided cubical position, dividend and hazard die 66, with the perspective view of FIG. 7B disclosing the other three sides 66*d*, 66*e*, and 66*f*. Sides 66*a* through 66*d* are conventional in nature, respectively being marked with values (dots or the like) of one through four, and providing for movement of the player position markers a corresponding number of spaces along the playing paths 14 through 18 of the board 10. However the fifth and sixth sides 66*e* and 66*f*, shown in FIG. 7B, are respectively marked to with the letters "D" and "M" to designate the drawing of a dividend card 60 or a hazard card 62, in accordance with the rules of play discussed further below.

Figure 8:
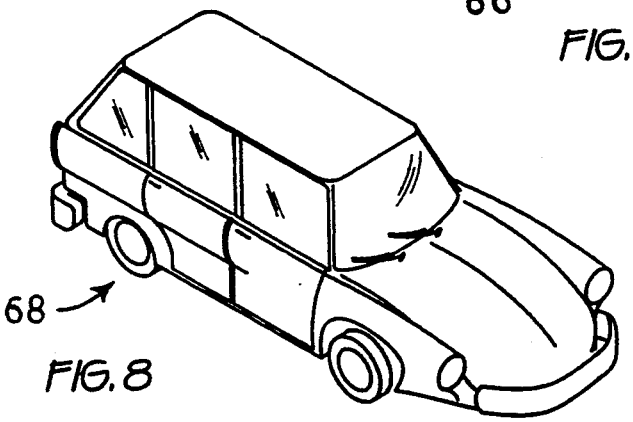
FIG. 8 is a perspective view of a typical player position marker or game playing piece of the present game.

FIG. 8 discloses a typical playing piece or player position marker 68. Markers 68 are placed on various spaces or positions 26 along the appropriate travel path 14 through 18, to indicate the game position of each of the players of the present game. The markers 68 are preferably in the form of a motor vehicle, but may be provided in different types of vehicles for differentiation.

The present game is played using the various game components and apparatus discussed above. The object of the present game is to be the first player to cross the map 12 of the U.S. in both directions using the appropriate designated playing path(s) 14 through 18, and to return their player position marker 68 to the appropriate start/end position 20 through 24 and pay off the "rent" due at that point.

The fact cards 58, dividend cards 60, and hazard cards 62 are placed in the appropriate fact card, dividend card, and hazard card positions respectively 52, 50, and 54 on the game board 10, with their front faces 58*a*, 60*a*, and 62*a* facing upward and their opposite rear faces 58*b*, 60*b*, and 62*b* facing downward so as not to be visible to the players during play. Each player is issued an equal amount of simulated currency 56 (e.g., $250 each) to begin the game and to meet potential game expenses along the way, and each player selects one of the player position markers 68, which will be used by that player to designate his/her position on the game board 10 during the course of the game.

The colored route selection die 64 is tossed by each player in turn, to determine which of the corresponding routes or paths 14 through 18 will be taken initially by each player, and the player position markers 68 of the players are placed on the appropriate starting and ending points 20 through 24 corresponding to the routes or paths 14 through 18, adjacent the "auto rental" designation at the east coast. (The markers 68 are preferably not distinguished by color, as they may be traveling along differently colored routes during the course of play, and a corresponding color marker and path at one point in the game may not hold throughout the entire game.)

At this point, the numbered/dividend/hazard die 66 is tossed in turn by each player, in order to determine the order of play. The player rolling the highest number (one through four) moves first. The die is tossed again in the case of ties or if the "D" or "H" indications come up. (If there is some disagreement over the selection of player position markers 68, the above described method of determining the order of play may be used to determine which player is assigned which marker 68.)

The first player, as determined above, then tosses the numbered die 66 to determine his/her first move, with play continuing after each player's move according to the order of play previously determined. If the die 66 comes up on any of the numbered faces one through four (faces 66*a* through 66*d*), that player's marker 68 is advanced a corresponding number of positions 26 along the appropriate path, and the die 66 is passed to the next player for that player's move, assuming that the final position for that move is not a dividend position 40, fact position 42, or hazard position 44.

However, if the die 66 comes up indicating a dividend, by means of the "D" face 66*e*, then the player must also draw an appropriate dividend card 60 from the top of the appropriate stack 50, and act according to the instructions thereon. In the case of a dividend card 60, the instructions may provide an additional payment to that player, or cause the player to advance a given number of positions 26. (An advance may place that player's position marker on a dividend, fact, or hazard position 40, 42, or 44, requiring further action before play passes to the next player.) The roll of either a "D" or "H" by a player is considered a turn by that player and no further move is permitted at that turn.

In the case of the die coming up to indicate a hazard, by the "H" face 66f, the player must draw a hazard card 62 and act according to the instructions on the rear face 62*b* thereof. This may result in the player having to pay some amount of simulated currency 56 back to the game (currency does not change hands directly between players during the game), or causing the player to lose a turn. Once the move has been completed (and any action required, with the exception of the loss of a turn, in which case that player's turn is surrendered on the next round of play), the position/dividend/hazard die 66 is passed to the next player and the above described procedure is repeated.

If the numbered move results in the player landing upon a dividend position 40 or hazard position 44, then the player must draw the first card 60 or 62 from the appropriate stack 50 or 54, and act according to the instructions thereon in the manner described above for acting upon a "D" or "H" indication by the position die 66. However, the numbered move may result in the player landing upon a fact position 42. As both the question and the answer are on the same side of the fact cards 58, the player to the immediate right of the player who landed upon the fact position 42, will actually draw the card 58 and read the question to the player on the fact card position. (If the right hand player is unable to read the question for whatever reason, another player other than the player on the fact card position may read the question.) A correct response by the player on the fact card position 42 will result in payment of $100 to that player by the game. An incorrect response is not penalized, but no reward is given for an incorrect response. All cards 58, 60 and 62 are returned to the bottom of their respective stacks after use.

As play progresses, with each player alternatingly tossing the position/dividend/hazard die 66 and moving or drawing a card 58, 60 or 62 accordingly, they will encounter spurs 46 extending to the sides of the playing paths 14, 16, and 18. "Rest areas" 48 are located at the ends of each of the spurs 46, each designated by the letter "A" therein. Players may bypass such spurs 46 and their rest areas 48 if they wish; travel along those portions of the playing paths is optional. However, a player choosing to do so and alighting upon one of the rest areas 48, is given the opportunity to respond to a question from a fact card 58, if he or she desires. As in the procedure described above, the player to the "rest area" player's right (or other literate player) reads the question to the "rest area" player. A correct response results in a payment of $100 in simulated currency from the game to the "rest area" player.

A player seeking additional game funds may wish to enter one of the spurs 46 and rest areas 48 along the path 14, 16, or 18 along which they are proceeding, and attempt to answer a fact card 58 question; it will be seen that the rest areas 48 provide an opportunity for a player who has suffered financial losses during the game to make up such losses in order to have adequate currency 56 to pay off the "car rental" at game end. However, players must toss the exact number reguired in order to alight upon the "rest area" position 48. A player who is three positions from the rest area position 48 at the end of one of the spurs 46, and who rolls a four on the die 66, must proceed along their travel route 14, 16 or 18 and bypass the spur 46. As there are two spurs 46 and rest areas 48 along each of the travel paths 14, 16 and 18, players will have a total of four chances to enter a rest area 48 as they travel one of the paths across the map 12 and return to the starting point.

The game continues as described above until the players reach the intermediate positions 34, 36 or 38, respectively at the ends of the paths 14, 16 and 18 opposite the combined starting and ending points 28, 30, and 32 for those paths. Upon approaching the appropriate intermediate position 34/36/38, the players must roll the position/dividend/hazard die 66 to provide the exact count needed to reach the appropriate intermediate position 34/36/38, without exceeding that position. This is because the game provides for potential return to the starting position along a different path than that traveled to the intermediate position, and passing the intermediate position 34/36/38 without knowing the return path is not possible according to the rules. As an example, a player who is two positions from the intermediate position 36 of the central path 16, and who rolls a four with the die 66, may not advance on that turn. (A one would allow the player to advance within one position of the intermediate position.)

Upon exactly reaching the appropriate intermediate point or position 34/36/38, a player must determine his/her return path to the appropriate starting position 20/22/24. This is done using the colored route selection die 64, in the manner described above at the start of the game for initially selecting the route for each player. Players may return along the same path as that used for the first half of the game, or may travel back to the start using a different path, depending upon the roll of the die 64. When the return path has been determined, the player must then roll the position/dividend/hazard die 66 to determine the count of the move back along the path toward the start position. This step will be accomplished by each player as they alight upon their respective intermediate positions 34/36/38 prior to returning to the start.

It will be seen that more than one player may end up along the same travel path, both at the start of the game and during the return phase of the game, according to the roll of the route selection die 64. This is permitted, and two (or more) playing pieces 68 may occupy the same path 14/16/18 and may even occupy the same position 26 along a path, depending upon the roll of the die 66 and any loss of turn or advancement which may result from the drawing of a dividend or hazard card 60 or 62. It will also be seen that some players may be advancing their markers 68 toward the intermediate positions 34/36/38, while other players have passed those positions and are returning toward the starting positions 20/22/24, even along the same path. Again, this is permitted, and the markers 68 are allowed to pass one another either in the same direction or opposite directions along a given path, according to the toss of the position/dividend/hazard die 66 and instructions of any dividend or hazard cards 60 or 62 encountered.

Play during the return phase of the game is conducted in the same manner as for the outward bound phase described above, with the players alternatingly tossing the position/dividend/hazard die 66, advancing their position markers 68 back toward the appropriate starting point 20/22/24, and/or drawing dividend-/hazard/fact cards and proceeding as described above. When a player closely approaches the combined starting and ending points 28/30/32 for the paths 14/16/18 add the game start/end points 20/22/24 at the "auto rental" location, the player again must roll the exact number required to exactly land upon the appropriate start/end point 20/22/24 for the path upon which that player is returning, without exceeding the required number. This is the same procedure as that for beginning the return phase at the intermediate positions.

Even though a player may roll the precise number required to "go out" and place his/her marker back at the appropriate "auto rental" position 20/22/24, the player may optionally be required to have an amount of simulated currency at least equal to that provided to the player at the start of the game (e. g., $250); a player must at least have some positive balance in order to continue to "go out" at the end of the game, in order to "pay off the rental car." A player who has encountered financial losses during the course of play and who has insufficient funds to complete this last step, is not allowed to proceed until acquiring sufficient funds. (It will be seen that a player may run out of funds during the course of play, due to encountering numerous hazards. That player may be allowed to continue, but any payment due for hazards along the way must be provided before the player completes the game, as by correctly answering fact card 58 questions or drawing a dividend card 60 which provides some payment.)

If the player is within two positions of completing travel along a path, then the only chance the player will have is to roll a "D" (dividend) with the position/-dividend/hazard die 66, and to draw a dividend card 60 which provides sufficient funds to provide a total which is high enough to provide the end of game payoff, as described above. These requirements (exact count on the roll of the die 66 and sufficient funds) will be seen to have the advantage of "tightening up" a game in which one player has been able to advance beyond all the others, by retarding the progress of the advanced player while he/she attempts to roll the required number, and-/or acquire the needed currency to return to the appropriate "auto rental" start/end point 20/22/24 to win the game.

The above described game apparatus and method of play provides an excellent means of teaching the players (particularly younger players) various facts and geopolitical knowledge of the United States, while providing entertainment as well. The rules are sufficiently unsophisticated to allow younger persons to enjoy the game without being overwhelmed by complexity, and the requirement at the intermediate and end portions of the game for players to roll the exact number required, as well as for players to have sufficient funds at the end of the game, result in the potential retarding of the progress of an advanced player and allowing others to gain on or pass that player, thus providing a suspenseful game in which the outcome is never assured until the very end.

It is to be understood that the present invention is not limited to the sole embodiment described above, but encompasses any and all embodiments within the scope of the following claims.

I claim:

1. A method of playing a board game comprising the following steps:

providing a game board including a geopolitical map of the United States thereon, and further including plural color coded playing paths thereacross, with each of the playing paths including plural sequential positions thereon and beginning and intermediate ends, and further providing a common starting and ending position at one side of the board;

providing a distinct player position marker for each player;

further providing a plurality of dividend cards and a plurality of hazard cards, respectively providing rewards and penalties to players during the course of play;

further providing first chance means for the determination of the playing path to be used by each player at the beginning and midpoint of the game, and second chance means for the determination of the magnitude of each move by each player and for the drawing of dividend and hazard cards:

further providing a like amount of simulated currency to each of the players;

selecting a first and subsequent players by using the second chance means;

selecting playing paths for each of the players by using the first chance means:

having the first through subsequent players each move their player position markers sequentially in turn according to the number indicated by the second chance means, and draw dividend and hazard cards according to the second chance means, as appropriate;

rewarding and penalizing each of the players respectively according to instructions provided on the dividend and hazard cards;

reaching the intermediate ends of the playing paths and using the first chance means to determine the return playing paths to be used by the players to move their player position markers back toward the common starting and ending position, and;

determining a winner by the first player reaching the common starting and ending position of the game board with their player position marker.

2. The method of playing a board game according to claim 1, including the steps of:

providing additional player positions extending laterally from the playing paths, and allowing players to move their position markers to the additional player positions.

3. The method of playing a board game according to claim 2, including the steps of:

providing a plurality of fact cards having questions relating to United States geography thereon, allowing players alighting on the laterally extending player positions to answer questions on the fact cards, and rewarding players answering correctly by providing them with additional simulated currency.

4. The method of playing a board game according to claim 3, including the step of:

requiring a player to attain the exact number required to alight upon one of the laterally extending player positions with the second chance means, in order to move their player position marker to that laterally extending player position.

5. The method of playing a board game according to claim 1, including the step of:

requiring a player to have a net positive balance of simulated currency in order to win the game.

6. The method of playing a board game according to claim 1, including the step of:

requiring a player at game end to have an amount of simulated currency at least equal to that provided at the start of the game.

7. The method of playing a board game according to claim 1, including the step of:

requiring a player to attain the exact number required to alight upon the common starting and ending position by using the second chance means, in order to win the game.

8. The method of playing a board game according to claim 1, including the step of:

requiring a player to attain the exact number required to alight upon the intermediate end of a playing path by using the second chance means, to allow that player to proceed along a playing path to return to the common starting and ending position.

9. The method of playing a board game according to claim 1, including the step of:

providing a color coded first chance means, with colors corresponding to the color coding of the plurality of playing paths.

10. The method of playing a board game according to claim 1, including the step of:

providing a second chance means comprising a six sided die, having numbers one through four respectively on four sides and dividend and hazard card indicators respectively on two sides.

11. A board game comprising:

a game board having a geopolitical map of at least the forty eight contiguous states of the United States thereon, with plural playing paths with an equal number of spaces on each path extending from a first edge of said map across said map to an opposite second edge of said map;

said game board further including a common starting and ending position adjacent said first edge of said map, with each of said playing paths having a different color and comprising a plurality of playing positions;

a plurality of distinct player position markers;

a plurality of dividend cards and a plurality of hazard cards;

color coded first chance means providing for the selection of one of said playing paths by each player;

second chance means including means providing for the determination of the amount of each player position marker move and further including means providing for the determination of the chance selection of said dividend cards and said hazard cards, and;

a quantity of simulated currency, whereby;

players of said board game simulate travel across the United States by means of said player position markers and said plural playing paths randomly selected by said first chance means, and randomly experience dividends and hazards according to said dividend cards and said hazard cards randomly selected in accordance with said second chance means.

12. The board game of claim 11 including:

a plurality of additional player positions extending laterally from said playing paths of said game board.

13. The board game of claim 11 including:

a plurality of fact cards having questions relating to United States geography thereon.

14. The board game of claim 11 wherein:

said color coded first chance means comprises a die having six sides thereon, with said sides having a plurality of different colors thereon.

15. The board game of claim 14 wherein:

said different colors of said sides of said color coded first chance die correspond to said different colors of each of said playing paths.

16. The board game of claim 11 wherein:

said second chance means comprises a die having first through sixth sides thereon, with said first through said fourth sides having numbers one through four thereon and said fourth through said sixth sides having dividend and hazard card indicators thereon.

* * * * *